United States Patent [19]

Sammons et al.

[11] 4,175,040

[45] Nov. 20, 1979

[54] CENTRIFUGAL WATER OIL SEPARATOR

[75] Inventors: John K. Sammons, Marrero; Charles H. Fox, Jr., Slidell, both of La.

[73] Assignee: Continental Oil Company, Ponca City, Okla.

[21] Appl. No.: 937,391

[22] Filed: Aug. 28, 1978

[51] Int. Cl.[2] ..... B04B 1/12

[52] U.S. Cl. ..... 210/78; 210/371; 210/379; 210/382; 233/19 R; 233/47 R

[58] Field of Search ..... 210/730 W, 78, 360 R, 210/369, 371, 378, 379, 382; 233/19 R, 46, 47 R

[56] References Cited

U.S. PATENT DOCUMENTS

| | | | |
|---|---|---|---|
| 468,858 | 2/1892 | Williamson | 210/371 |
| 499,349 | 6/1893 | Peck | 233/23 R |
| 2,683,535 | 7/1954 | Smith | 210/382 |
| 3,536,254 | 10/1970 | Knight | 233/19 A X |
| 3,552,575 | 1/1971 | Hultsch | 210/369 |

*Primary Examiner*—William A. Cuchlinski, Jr.
*Attorney, Agent, or Firm*—Cortlan R. Schupbach, Jr.

[57] ABSTRACT

A centrifugal oil-water separator comprising an inner spinning bowl having openings near the lower outer periphery for passage of water therefrom into an outer bowl which remains stationary. The oil-water mixture is passed to the upper center of the spinning bowl with separation of the oil and water therein, concentrating the oil near the top of the inner bowl and disposable water is removed from the outer bowl.

9 Claims, 4 Drawing Figures

CENTRIFUGAL WATER OIL SEPARATOR

Figure 1:
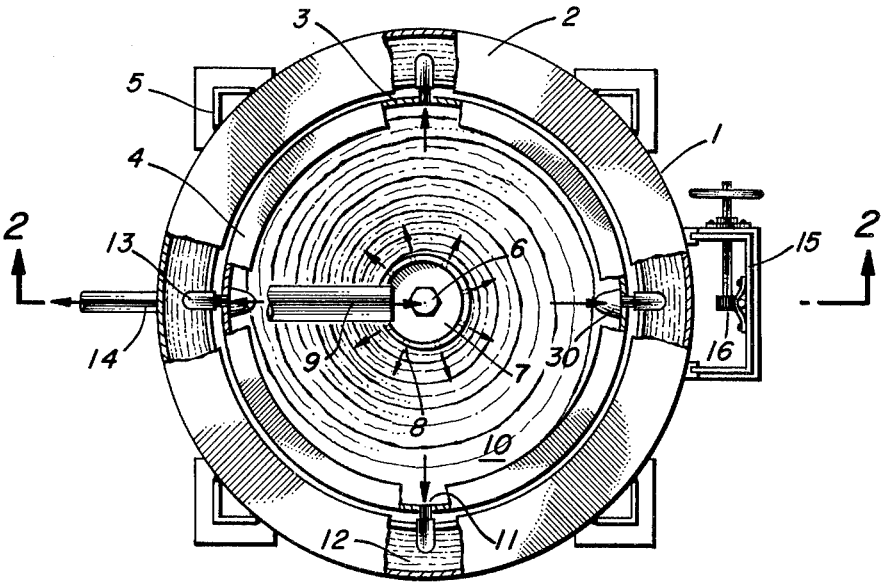

This invention relates to a method for recovering oil intermixed with water. More particularly, this invention relates to a method for recovering oil intermixed with water by use of a centrifugal separator which is simple in nature and requires no chemical separating agents.

Severe environmental problems have occurred from water pollution caused by accidental spills or leakage of petroleum or other hydrocarbon liquids into bodies of water. These spilled materials are dangerous to marine life, wildlife living on or near the water, and have made rivers and oceans asthetically unpleasant. Many methods have been devised for combating such accidental spills. For example, some devices involve skimming the body of water to remove an upper oily layer employing blades, belts, absorbant rollers and the like. These methods suffer from several disadvantages among which are intricate machinery, low rates of recovery, and inability to operate effectively where wave action is high. These recovery devices usually are moved about on the water surface to contact the oil film in order to affect recovery, or have been employed with additional devices to bring the oily film to the recovery apparatus.

Many devices have been shown in the prior art for such recoveries. Among these are U.S. Pat. No. 4,038,182 which discloses an oil-water separator for removing films of oils from the surface of water, wherein the oily film and water flows into a vortex formed by an impeller section and then outwardly into a housing wherein oil in a layer of enhanced thickness is collected and drawn off from time to time. U.S. Pat. No. 3,800,951 discloses a separator for removing films of oil from the surface of water wherein a vortex is formed by an impeller within a housing just below the surface of the water. The oil constantly collects in the vortex and is drawn off by various means. Examination of the figures of these two references will shown them to be complex and designed for moving about in bodies of water.

U.S. Pat. No. 3,311,296 discloses a centrifugal separator which separates mixtures of brine, hydrocarbons and solidified wax using a spinning bowl. While the reference is directed toward the separation of solids from liquids, the brine and hydrocarbon liquid would be inherently separated in such an apparatus. However, an examination of the apparatus itself shows it to be clumsy, intricately constructed and subject to many malfunctions in commercial use.

U.S. Pat. Nos. 1,839,941 and 1,018,878 both show a slurry of solids and liquid which is put into the lower end of frustroconical spinning tubular bowl with liquids and fines passing through openings therein into a trough collector while large solids pass over the top into a second trough collector. Other references illustrative of this art are U.S. Pat. Nos. 4,044,626; 2,880,873; 2,831,369; 2,711,827; 2,534,194; and 1,782,224.

However, these references are designed to remove films from the surface of water, which object is usually frustrated by wave action, and/or are so constructed as to require the use of separating agents and sophisticated mechanical equipment.

However, hydrocarbon-water mixtures may be liquid (or on occasion solids in the divided state) which are less dense than the liquid on which it is spread. In many cases there is no clear-cut film of water on the top for the apparatus to separate. In the specification which follows, the terms "water" and "hydrocarbon" or "oil" will signify respectively the body of liquid and the substance intermixed with said liquid, but it wll be clear that the use of these terms is not intended to be of a restrictive nature.

Water used in production methods is also subject to being contaminated with hydrocarbons. This water, before being returned to the environment, must normally meet concentration levels sufficiently low to allow the environment to degrade the mixed hydrocarbons without harm. The recovered oil is processed as production oil.

However, in times of high production or in times of equipment failure, the water exiting these clean-up devices is often intermixed with hydrocarbons at a sufficiently high level to prevent return of said water to the environment. For example, on offshore production platforms, low pressure separators such as corregated plate interceptors are used to separate oil from water. In these interceptors, which are essentially settling tanks having large surface area plates therein to allow oil and water time to separate, allowing the oil to be skimmed from the surface and the water returned to the environment, it has often been found that as high as 1,000 parts per million oil concentration remains in the water. United States government limits for water returning to oceans is 50 parts per million, and many states have lower limits near the coastline, such as Louisiana with 30 parts per million. Similar environmental limits exist or are contemplated throughout the world.

It would therefore be of great benefit to provide a simple, efficient apparatus for reducing the oil content of water recovered from production means and withdrawn from contaminated areas to levels environmentally acceptable. It is therefore an object of the present invention to provide an apparatus and method for removing oil from water. Other objects will become apparent to those skilled in this art as the description proceeds.

The method according to the instant invention comprises the steps of centrifugally separating the oil and water using an inner spinning bowl having openings near the lower outer periphery for passage of water therefrom into an outer bowl which remains stationary. The oil-water mixture is inserted into the upper center of the inner spinning bowl with separation of the oil and water therein and concentration of the oil near the top of the inner bowl. Disposable water is removed from the outer bowl and oil is recovered from a trough adjacent the top of the spinning inner bowl.

The invention is simple, has no complicated internal structure, and has a minimum of moving parts for easy maintenance. The inner bowl is rotated at a speed effective to make oil climb to the exit ports in the upper rim thereof. The speed of the inner bowl's rotation is not fixed, depending as it does upon the diameter of the bowl and the concentration of oil in water. However, the revolutions per minute (rmp) of the spinning inner bowl will normally be from about 75 to about 90 rmp based upon a 24 inch diameter inner bowl. Such an apparatus can, of course, be constructed at any desired size, but normally in commerical applications would be of a size capable of handling from about 1,000 to 2,000 barrels per day of oil-water mixtures. An apparatus having an inner bowl of three feet diameter and three feet in depth should separate about 1,000 barrels per day of oil-contaminated water.

The invention is more concretely described and can be more clearly explained with reference to the drawings. Generally described, the drawings show a top and side view of a centrifugal oil-water separator having an inner spinning tub or bowl, said bowl having openings near the lower outer periphery for passage of water therefrom into an outer bowl which remains stationary and openings near the upper outer periphery of the inner bowl for passage of oil therefrom into a channel rigidly affixed to the stationary bowl in the annulus between the nested bowls. The oil-water mixture is inserted in the upper center of the rapidly rotating inner bowl with consequent separation of the oil from the water therein and concentration of the oil near the top of the rotatable inner bowl and passage of substantially oil free water from the inner bowl to the outer bowl. An alternate liquid leveling means is also described.

Specifically described,

FIG. 1 shows a partial cutaway top view of an apparatus of the instant invention. In the figure the apparatus used comprises an outer bowl (1) having affixed to the upper periphery thereof a flange (2) extending toward the inner bowl (3) which in turn has a flange (4) extending toward the interior of the inner bowl. The outer bowl is stationary and is supported by convenient supports (5) which can be of any physical configuration sufficient to support the weight. The bowls are penetrated by a shaft (6) which is rigidly fixed to a perforated basket (7) having aperatures (8) therein. The oil-water mixture to be separated enters the apparatus through an inlet conduit (9) which passes the mixture to be separated directly into the perforated basket. The oil-water mixture is rotated at a speed sufficient to force the oil (10) to the surface of the water, said oil being concentrated near multiple aperatures (11) substantially adjacent the flange at the outer periphery of the inner rotating bowl, said aperatures being in direct communication to the channel (12) which is rigidly affixed t the outer bowl (1) at a distance below the upper aperatures (11) of the rotating inner bowl (3). Optionally, pipes or conduits (13) can be affixed to these upper aperatures in order to facilitate passage of the recovered oil to the channel (12), which is in fluid communication with the exterior of the stationary bowl (14). The apparatus also describes an overflow weir (15) having an adjustable means (16) to level the amount of water leaving the apparatus in relation to the oil-water mixture entering the apparatus.

Figure 2:
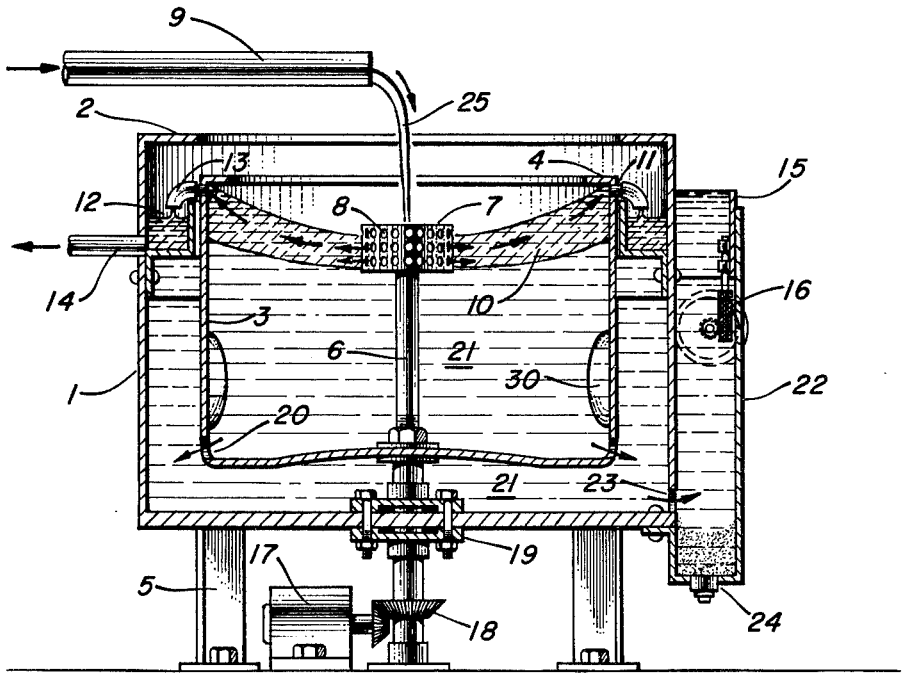

FIG. 2 generally describes a side sectional view of FIG. 1 along section 2—2. In addition to the components already described, it is apparent that the inner and outer nested bowls are penetrated completely by a shaft (6) which is connected to a motive means (17) through drive means (18) capable of rapidly rotating the inner bowl. The shaft penetrates the outer bowl through a sealing means (19) capable of preventing fluid passage therethrough while allowing the shaft to rapidly rotate. The inner bowl is penetrated at its lower portion by multiple aperatures (20) which allow the passage of substantially oil free water (21) to the outer bowl, said water then passing into the liquid leveling means (22) which is attached to the overflow weir and adjusting means and is connected to the outer bowl through an aperature (23). The inner bowl optionally contains small flanges (30) vertically attached to the inner wall to impart motion to the bowl contents therein. The figure also describes an optional trap (24) for solid contaminants, having an aperature therein for removal of said settled contaminants from time to time. The separated oil (10) exits the channel (12) through an aperature (14) while the recovered, substantially oil free water exits the leveling apparatus through an overflow weir (15).

Figure 3:
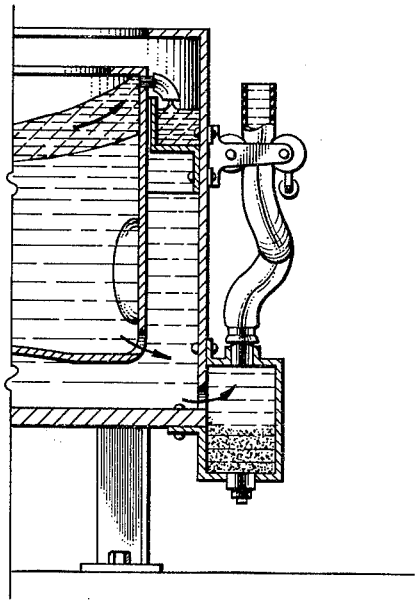

FIG. 3 describes an alternate liquid leveling means to replace the wier plate described in FIGS. 1 and 2. The liquid level is adjusted by simply raising or lowering the hose such that the overflow occurs at the liquid level desired in the rotating drum.

Figure 4:
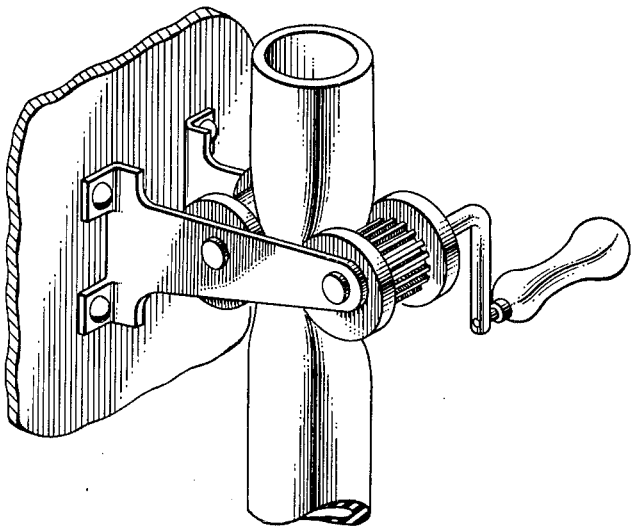

FIG. 4 is a perspective view of the liquid leveling means.

In practice then, the method of the instant invention comprises placing an oil-water mixture (25) into a dispersing apparatus (7) which is at the center of a rapidly rotating bowl or tub (3). Oil free water is normally added to the apparatus prior to beginning insertion of the oil-water mixture in order to prevent premature escape of oil through the lower aperatures (20) of the inner bowl (3) prior to the apparatus having operational capacity of an oil-water mixture. Once the inner bowl is rapidly rotating and the oil-water mixture is inserted into the dispersing means (7), the centrifugal force of the rapidly rotating inner bowl tends to force the lighter oil to the upward outer periphery of the bowl and through the multiple aperatures at the upper periphery of the inner bowl into the channe rigidly affixed to the stationary outer bowl. The channel is provided with an oil drain to remove the recovered oil. The inner bowl and, optionally the outer bowl, are fitted with flanges projecting toward the interior of the respective bowls in order to prevent escape of oil due to the centrifugal force of the separating means, although when in proper balance the outer bowl flange is not necessary. Water recovered from the oil-water mixture exits the inner bowl through the aperatures at the lower portion of the bowl and enters the annulus between the two nested bowls. The water level is critical to the method of the instant invention and must be carefully adjusted by the use of an overflow weir or other leveling means. The amount of recovered oil and substantially oil free water removed from the apparatus must equal the inflow of oil-water mixture to be separated for the method to operate efficiently. This is most easily accomplished by simply adjusting the amount of water leaving the overflow weir.

In addition, the figure shows an optional contaminant trap useful when the oil-water mixture contains large amounts of sediment and sand.

Thus the apparatus and method described provides a simple method for separating oil from water mixtures with a minimum of moving parts and simple construction details. It will be clear to those skilled in the art that instruction details can be varied somewhat from the description shown. For example, the outer bowl could be a square, retangular, or other geometric configuration so long as the channel is circular and collects the oil which exits the inner rotating bowl through the ports around the upper periphery. The water leveling means shown in FIG. 3 is replaced by a simple hose adjusted at varying heights to control the water level in the inner bowl and the annulus between the inner and outer bowl. Means for removing solid contaminants entirely around the lower periphery of the outer bowl could likewise be provided for example.

A model apparatus was built having an inner drum diameter of about 24 inches. A mixture of oil and water from a low pressure separator containing various amounts of hydrocarbons was inserted into the apparatus. The inner drum was rotated at approximately 80 rpm. Samples were collected as the oil-water mixture entered the separator and samples of exit water were collected to determine the levels of hydrocarbon therein. The test was carried out and samples collected at times of ½ hour, 1 hour, and 1½ hour duration. At 11:00 a.m. the inlet boil concentration was 52 parts per million from the low pressure separator, unacceptably high for transmittal to the environment. The outlet water contained 10 parts per million oil. At 11:30 a.m. the inlet water contained 44 parts per million oil, while the water outlet concentration dropped to 7 parts per million oil. At 12:30 p.m. the inlet oil concentration was 28 parts per million and the outlet water concentration was 3.5 parts per million. At 2:00 p.m. the inlet oil concentration had risen to 50 parts per million and the outlet water concentration was at a low 12 parts per million.

A second oil mixture was passed through the oil-water separator. The mixture was carefully designed to contain about 40% oil by weight. The mixture was passed into the separator for a time sufficient for an equilibrium to be reached. Analysis of the exit water showed only 17 parts per million oil in the water exiting the separator.

It can be seen from the actual examples carried out that essentially complete separation of oil-water mixture is obtained. The oil does not have to be dispersed upon the surface of the mixture entering the separator, although such a dispersal would be separated as easily as intermixed oil-water mixture.

As set forth above, the instant invention requires no chemical aids for separation, thus insuring the purity of the water removed and the non-contamination of the oil recovered.

Normally the oil content of the water entering the apparatus will range from about 25 parts per million to about 50% by weight. However, the apparatus is entirely capable of separating even higher oil contents and efficiently yielding purified water. Normally the oil in the water outlet will range from about 3 parts per million to about 50 parts per million depending upon the method of operation and the proper balancing of the separated oil. If greater purity is desired several such apparatus could be utilized in series, the exit water from the first passing through the second and so on. Such a series would effectively remove oil from the water in a simple efficient and rapid manner. Normal oil concentrations in water exiting the apparatus from a first pass basis would range in the area of about 12 parts per million based on normal water concentration inputs of about 50 to about 1,000 parts per million, using water from conventional separating methods which is unacceptably high in oil content. Water cleansed of hydrocarbons by the method of the instant invention is sufficiently pure to be returned to the environment.

While certain embodiments and details have been shown for the purpose of illustrating this invention, it will be apparent to those skilled in this art that various changes and modifications may be made herein without departing from the spirit or scope of the invention.

We claim:

1. An apparatus for recovering oil from oil water mixtures comprising two nested bowls; an outer stationary and an inner rotating bowl having an annulus therebetween, the inner bowl having a flange affixed to the upper periphery thereof and covering a portion of the bowl interior, each bowl being penetrated by a shaft, said shaft being rigidly affixed to the inner bowl and rotatably attached to the outer bowl by means sealing the shaft aperature from liquid passage, said shaft connected at the lower end to motive means capable of rapidly rotating said shaft and at the upper end to a perforated basket rigidly fixed to said shaft, said inner bowl having multiple aperatures in the lower portion thereof and multiple aperatures at the upper periphery thereof substantially adjacent said flange and a groove or channel in the annulus rigidly affixed to said stationary outer bowl at a level below the level of the upper aperatures in the rotatable inner bowl, the lower portion of said channel in fluid communication with the exterior of the stationary outer bowl and at least one aperature in the lower portion of the outer bowl in fluid communication with a fluid leveling means capable of balancing inflow and outflow.

2. An apparatus as described in claim 1 wherein the upper aperatures of the inner bowl are attached to hose or pipe means of sufficient length to transport recovered oil fluid to said channel.

3. An apparatus as described in claim 2 wherein the liquid leveling means is an adjustable weir plate.

4. An apparatus as described in claim 3 wherein the lower portion of the outer bowl has means for removing settled solid contaminants.

5. An apparatus as described in claim 2 wherein the liquid leveling means is a hose.

6. An apparatus as described in claim 1 wherein the outer bowl has a flange affixed to the upper periphery.

7. A method for continuously recovering oil from oil-water mixtures comprising placing a stream of oil-water mixture into an oil-water separator having an outer stationary bowl and an inner rotatable bowl having an annulus therebetween, the inner bowl having a flange affixed to the upper periphery thereof and covering a portion of the bowl interior, each bowl penetrated by a shaft said shaft being rigidly fixed to the inner bowl and rotatably attached to the outer bowl by means sealing the shaft aperature from liquid passage, said shaft having at the upper end a dispersant means rigidly affixed to said shaft, said inner bowl having multiple aperatures in the lower portion thereof and multiple aperatures at the upper periphery thereof substantially adjacent said flange, and a groove or channel in the annulus between the bowls, rigidly fixed to said stationary outer bowl at a level below the level of the upper aperatures in the periphery of the rotatable inner bowl, said channel being in fluid communication with the exterior of the outer bowl; at least one aperature in the lower portion of the outer bowl in fluid communication with a fluid leveling means capable of balancing inflow and outflow, wherein oil-water mixture entering the rapidly rotating dispersing means passes into the rapidly rotating inner bowl, separates into heavier water in the lower portion thereof and lighter oil at the upper portion thereof, the centrifugal force passing the oil to the upper portion thereof and through said aperatures into a channel from which oil is recovered, and water is passed through the lower aperatures thereof into the annulus from whence said water flows to a fluid leveling means whereby the inflow and outflow are balanced.

8. A method as described in claim 7 wherein solid contaminants are removed from the bottom of the oil-water separator.

9. A method as described in claim 7 wherein the ratio of oil to water is from about 25 parts per million to about 50 percent by weight.

* * * * *